US009612605B2

(12) United States Patent
Tang et al.

(10) Patent No.: US 9,612,605 B2
(45) Date of Patent: Apr. 4, 2017

(54) VOLTAGE REGULATOR WITH CURRENT FEEDBACK

(71) Applicant: Micron Technology, Inc., Boise, ID (US)

(72) Inventors: Qiang Tang, Cupertino, CA (US); Ruo-Gu Huang, San Jose, CA (US); Xiaojiang Guo, San Jose, CA (US)

(73) Assignee: Micron Technology, Inc., Boise, ID (US)

( * ) Notice: Subject to any disclaimer, the term of this patent is extended or adjusted under 35 U.S.C. 154(b) by 14 days.

(21) Appl. No.: 14/661,706

(22) Filed: Mar. 18, 2015

(65) Prior Publication Data

US 2016/0274614 A1 Sep. 22, 2016

(51) Int. Cl.
*G05F 1/575* (2006.01)
*G05F 3/26* (2006.01)

(52) U.S. Cl.
CPC ..... *G05F 3/262* (2013.01)

(58) Field of Classification Search
CPC . G05F 1/56; G05F 1/156; G05F 1/575; G05F 1/585; G05F 1/1588; H02M 3/156–3/158; H02M 2001/0032; H02M 2001/0045
USPC ..... 323/272, 275, 280–285, 316, 907
See application file for complete search history.

(56) References Cited

U.S. PATENT DOCUMENTS 4,243,948 A * 1/1981 Schade, Jr. ..... G05F 3/20 323/316
4,766,364 A * 8/1988 Biamonte ..... G05F 1/59 307/58
2015/0180355 A1* 6/2015 Freeman ..... H02M 1/08 363/21.04

* cited by examiner

*Primary Examiner* — Yemane Mehari
(74) *Attorney, Agent, or Firm* — Schwegman Lundberg & Woessner, P.A.

(57) ABSTRACT

Generally discussed herein are apparatuses and methods for a voltage regulator with a current feedback loop. One such apparatus may include an amplifier, a master device electrically coupled to the amplifier, a slave device electrically coupled to the master device, and/or a current feedback device electrically coupled to the amplifier and the slave device to feed back current from the slave device to alter a monitoring voltage input to the amplifier.

20 Claims, 7 Drawing Sheets

VOLTAGE REGULATOR WITH CURRENT FEEDBACK

BACKGROUND

The semiconductor industry has a market driven need to reduce the size of devices, such as transistors or dies, and reduce the number of devices for a given apparatus. Some product goals include lower power consumption, higher performance, and smaller sizes. Various voltage regulator architectures decrease power consumption, some of which may sacrifice power consumed during a read or write operation for speed, bandwidth, or output voltage consistency.

DETAILED DESCRIPTION

Figure 1:
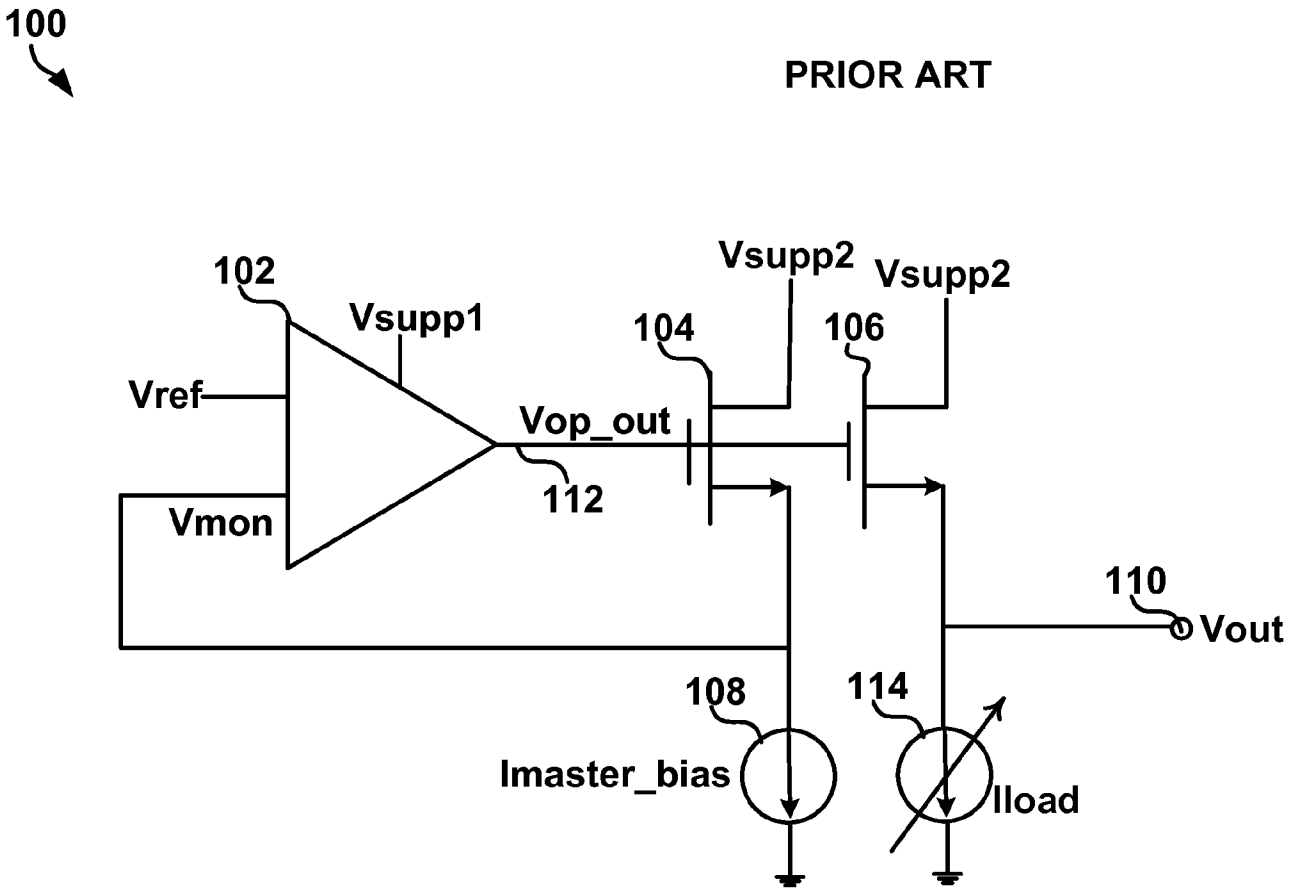
FIG. 1 shows a circuit diagram of a prior art voltage regulator.

A conventional master-slave voltage regulator may be used for supplying a constant voltage to a constant loading current. An example of a conventional master-slave voltage regulator is shown in FIG. 1.

As illustrated, the conventional voltage regulator 100 may include an operational amplifier 102 (sometimes referred to as a difference amplifier or an error amplifier), a master transistor 104, a slave transistor 106, a master bias current source 108, and an output 110. In the illustration, the master transistor 104 is biased with a constant current source (Imaster_bias from the master bias current source 108) to maintain a constant gate voltage on the connection 112 (Vop_out). The gate voltage (Vop_out) drives the slave transistor 106 to deliver the loading current (indicated by the variable current source 114 labeled "Iload").

The loading current provided by the regulator 100 may be changed by altering the aspect ratio of the slave transistor 106 to the master transistor 104. Generally Iload=n/m*Imaster_bias, where n is the aspect ratio (W/L) of the slave transistor 106 and m is the aspect ratio of the master transistor 104. The aspect ratio of a device may include a W/L value of the device, where W is the channel width (a distance between the source and the drain of the device), and L is a channel length (a length of a gate perpendicular to the channel width). If the actual loading current matches the expected current, the output voltage (Vout) will match the reference voltage (Vref), which is the desired voltage. One disadvantage of the regulator 100 is the inability to correct Vout if it is different than Vref. Vout may be different if the loading current (Iload) drawn by a load is larger or smaller than what the regulator 100 was designed to provide.

The master transistor 104, the operational amplifier 102, and the master bias current source 108 generally keep Vop_out constant, regardless of the loading current (Iload). As a result, as the loading current changes over time, Vout will change accordingly. The corresponding Vout variation depends on the dynamic range of the loading current (Iload). More specifically $Vout=Vop_out-Vth_slave-\sqrt{Iload/kslave}$, where Vth_slave is the threshold voltage of the slave transistor 106 and kslave is a parameter of the slave transistor 106 that is proportional to the slave transistor 106 aspect ratio, n, and some process parameters.

Current feedback may be implemented to help in adjusting the output voltage under various loading conditions, such as is shown and described with regard to other FIGS. discussed herein.

Figure 2:
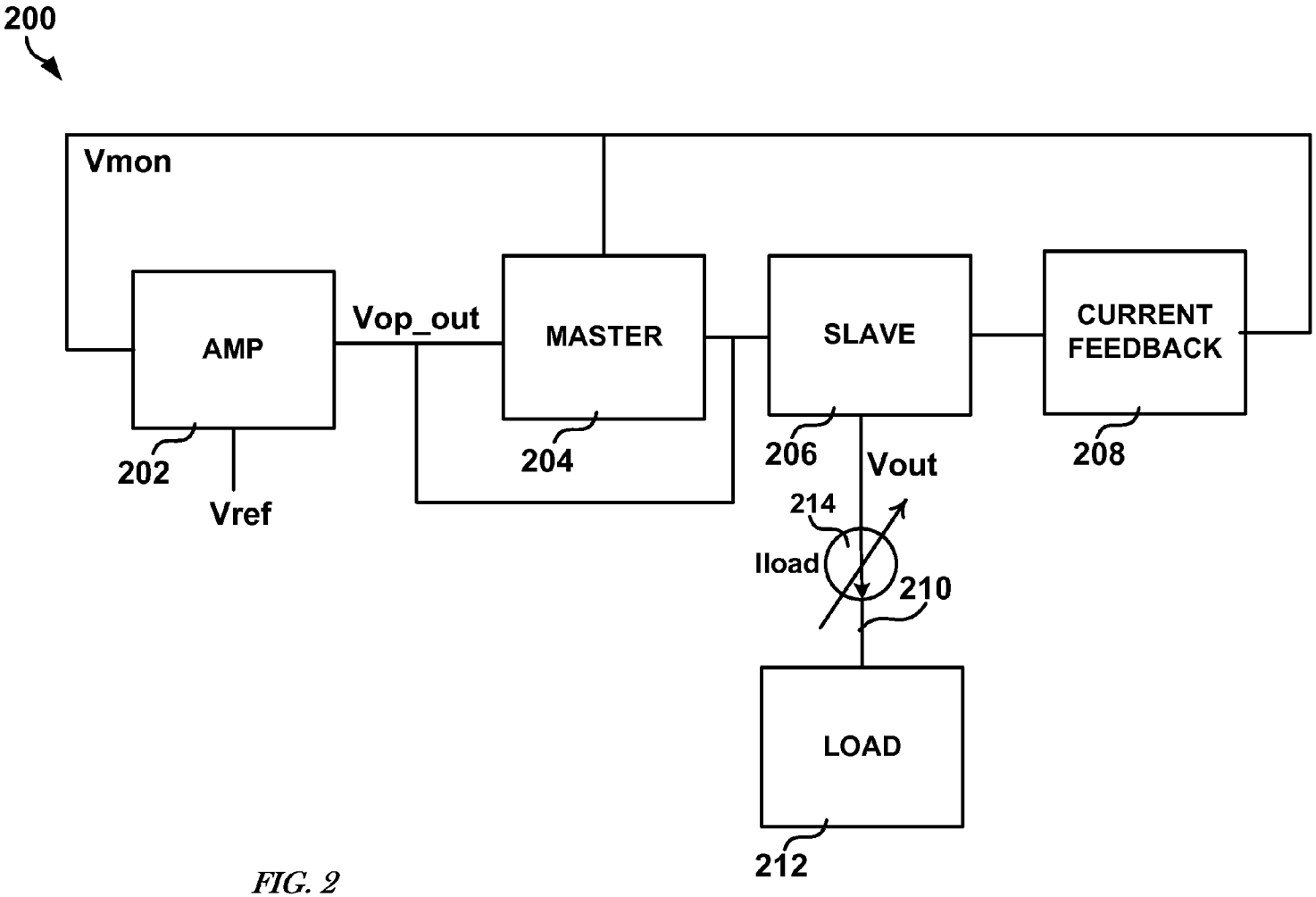
FIG. 2 illustrates, by way of example, a block diagram of an embodiment of a voltage regulator device.

FIG. 2 illustrates, by way of example, a block diagram of an embodiment of a master-slave voltage regulator device 200. The device 200 can include current feedback to help the device 200 provide a more constant output voltage under various loading conditions. The voltage regulator device 200 may help maintain a constant voltage, Vout, at an output 210 under varying loading conditions. The voltage regulator device 200 may include an amplifier 202, a master device 204, a slave device 206, and a current feedback device 208.

The amplifier 202 may include an operational amplifier, error amplifier, or a differential amplifier. The amplifier 202 may amplify a difference of the input signals Vref and Vmon. The magnitude of the amplification provided by the amplifier 202 may be a function of an aspect ratio of the master device 204 and an aspect ratio of the slave device 206.

The master device 204 may include one or more transistors, such as a Field Effect Transistor (FET), N-type Metal Oxide Semiconductor (NMOS) FET, P-type Metal Oxide Semiconductor (PMOS) FET, or other transistor. The master device 204 may receive Vop_out from the amplifier 202. The voltage from the amplifier 202 may control a current through the master device 204. In an embodiment where the master device 204 includes a transistor (e.g., a MOSFET), if Vop_out is greater than the threshold voltage of the master device 204, a current may flow through the source to or from the drain of the master device 204.

The slave device 206 may include one or more transistors, such as a FET (e.g., an NMOS FET or PMOS FET), or other transistor. The slave device 206 may receive Vop_out, such as from the amplifier 202 or from the master device 204. The voltage from the amplifier 202 (Vop_out) may control a current through the slave device 204, such as may be drawn by a loading device 212. The current drawn (represented by the variable current supply 214) through the slave device 206 may determine, at least in part, the voltage, Vout, at the output 210 from the slave device 206. A bigger current draw from the slave device 206 generally corresponds to a greater voltage at the output 210 (assuming a constant resistance).

A current feedback device 208 may be used to help compensate for a variable current draw and the corresponding variation in the voltage at the output 210. The current feedback device 208 may include a current mirror or other current feedback device. As previously discussed, the current draw from the slave device 206 is generally directly proportional to the voltage at the output 210. Thus, feeding back at least a portion of the current from the slave device 206 to the amplifier 202 may indicate the loading current and the output voltage, Vout, at the slave device 206. The amplifier 202 may compensate for the different loading conditions at the slave device 206 by increasing or decreasing the output voltage of the amplifier 202 (Vop_out) in accord with the changes in the feedback current. For example, if Vmon increases (because the loading current increased), the voltage from the amplifier 202 (Vop_out) may increase to help supply the increased loading current and retain the voltage at the output 210 (Vout) at a constant voltage. In an embodiment in which the amplifier 202 is a difference or error amplifier the increase in Vop_out may be from a difference between Vref and Vmon increasing in response to an increased loading condition at Vout.

Figure 3:
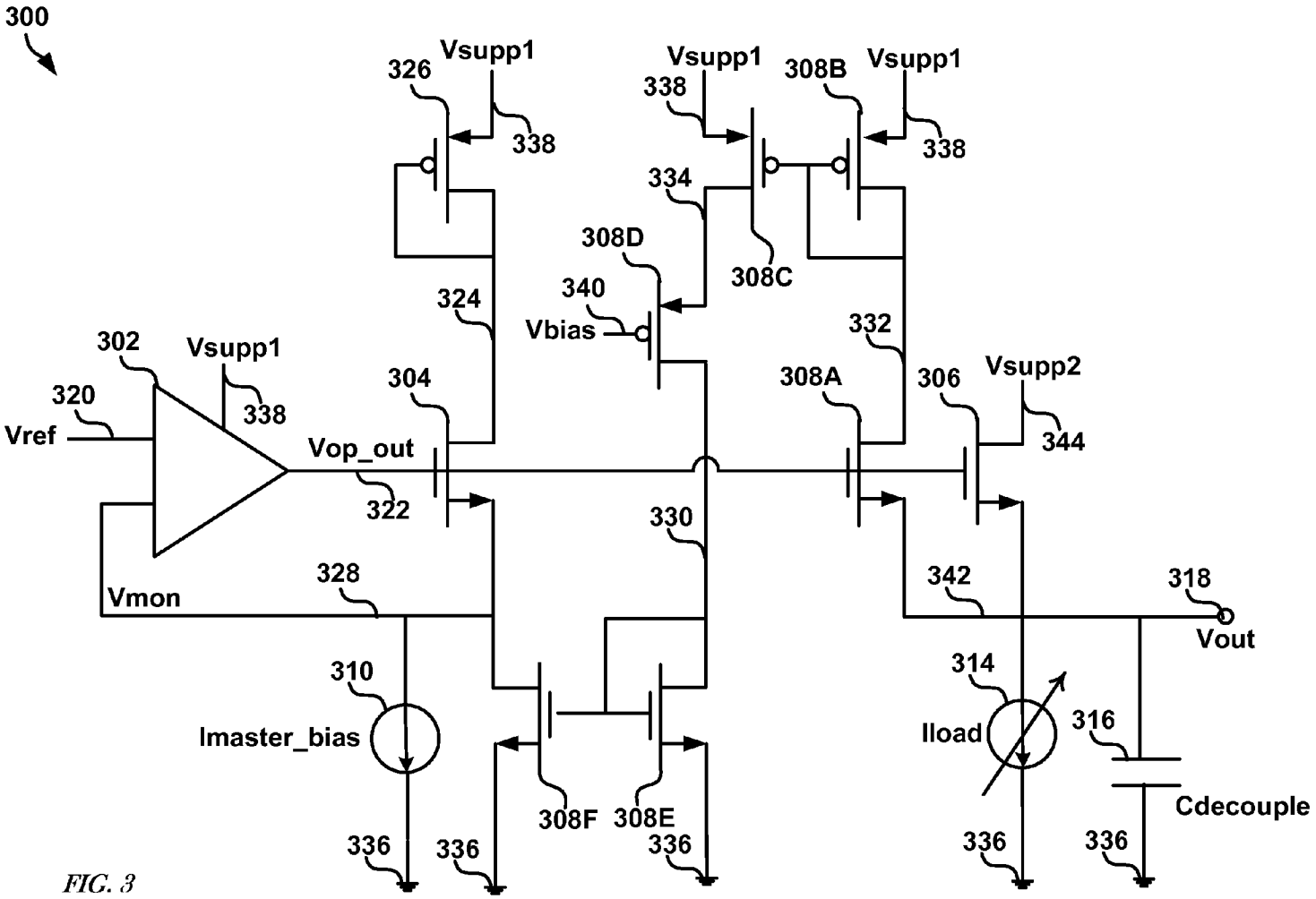
FIG. 3 illustrates, by way of example, a circuit diagram of an embodiment of a voltage regulator device.

FIG. 3 illustrates, by way of example, a circuit diagram of an embodiment of a master-slave voltage regulator device 300. The device 300 may include an amplifier 302, one or more master transistors 304, one or more slave transistors 306, and a current mirror. In FIG. 3, the current mirror comprises the transistors 308A, 308B, 308C, 308D, 308E, and 308F. The amplifier 302 may be an example embodiment of the amplifier 202, the master transistor 304 may be an example embodiment of the master device 204, the slave transistor 306 may be an example embodiment of the slave device 206, and the current mirror may be an example embodiment of the current feedback device 208.

The amplifier 302 may include an error amplifier. The amplifier 302 may be powered by a first supply voltage 338. The amplifier 302 may amplify a difference between a reference voltage (Vref) received on the connection 320 and a monitoring voltage (Vmon) received on the connection 328. Vref may be a reference voltage that indicates to the device 300 a target voltage at the output 318 indicated by Vout. Vmon may be a monitoring voltage that indicates to the amplifier 302 a value of the voltage at the output 318. The amplifier 302 may produce a voltage (Vop_out) at the connection 322 using Vref and Vmon. The amplifier may amplify a difference between Vref and Vmon such that Vop_out=A*(Vref−Vmon), where A is an amplification constant. The amplification constant may be adjusted by adjusting the aspect ratio, m, of the master transistor 304 or an aspect ratio, n, of the slave transistor 306. The constant, A, is generally determined by a ratio of n:m.

The master transistor 304 may include a gate electrically coupled to the output of the amplifier 302, such as through the connection 322. A drain of the master transistor 304 may be electrically coupled to a drain of a pull-up transistor 326, such as through the connection 324. A source of the master transistor 304 may be electrically coupled to an output of a current mirror and a current source 310, such as through the connection 328. The current source 310 may provide a bias current (Imaster_bias) to the master transistor 304. The current source 310 may be electrically coupled to a reference voltage (e.g., ground 336 as shown in FIG. 3). The current from Imaster_bias may be adjusted to add or adjust a skew between master and slave devices to keep the master loop stable.

The Imaster_bias and the current from the current mirror (Ifeedback, not labeled in FIG. 3) may affect the value of Vmon such that Vmon is proportional to the sum of Ifeedback and Imaster_bias. The voltages Vop_out and Vmon may control a resistance of the master transistor 304, such that the greater the difference between Vop_out and Vmon, the lower the resistance between the drain and the source of the master transistor 304. The lower the resistance between the drain and the source of the master transistor 304, the greater the current flow therethrough.

The pull-up transistor 326 may include a gate electrically coupled to the drain of the pull-up transistor 326. The pull-up transistor 326 may include a source electrically coupled to the first supply voltage 338. The pull up transistor may help match a bias between the master transistor 304 and the transistor 308A, such as to reduce voltage stress on the master transistor 304.

The slave transistor 306 may include a gate electrically coupled to the connection 322 (Vop_out). The slave transistor 306 may include a drain electrically coupled to a second supply voltage 344 (Vsupp2). A source of the slave transistor may be electrically coupled to an output 318. The output 318 may be electrically coupled to a load that may draw a variable loading current (indicated by the variable current supply 314). A decoupling capacitor 316 may be electrically coupled between the source of the slave transistor 306 and a reference voltage (e.g., ground 336 as shown in FIG. 3). The decoupling capacitor 316 may help shunt noise from the device 300 to ground 336 and reduce the effects of the noise on a device electrically coupled to the output 318. The decoupling capacitor 316 may have a high resistance to a lower frequency or direct current (DC) signal and a low resistance to a signal with a higher frequency, thus shunting the higher frequency signal and not the lower frequency signal.

The source of the slave transistor 306 may be electrically coupled to a source of a current mirror transistor 308A, such as through a connection 342. The connection 342 may provide a portion of the loading current drawn through the slave transistor 306 to the transistor 308A. The amount of current provided to the transistor 308A may be adjusted by adjusting the size ratio of the transistor 308A and the slave transistor 306.

A gate of the current mirror transistor 308A may be electrically coupled to Vop_out through the connection 322. A sufficient difference between Vop_out and Vout may cause the feedback current to flow through the drain of the transistor 308A to the gates of the transistors 308B and 308C through the connection 332. The gate of the transistor 308B may be electrically coupled to the drain of the transistor 308B through the connection 332. The transistors 308B and 308C may each include a source electrically coupled to the first supply voltage 338. The transistors 308B and 308C may mirror the current from the connection 332 to the connection 334 such that the current on the connection 334 may be a multiple of the current on the connection 332. The optional transistor 308D may help make the bias conditions of the transistors 308B and 308C match each other, such as can help improve current mirroring or for stress protection on the transistor 308C. In one or more embodiments that do not include the optional transistor 308D, the drain of the transistor 308C can be directly connected to the transistor 308E.

The transistors 308E and 308F may include a gate electrically coupled to the drain of the transistor 308D through the connection 330 or directly to the drain of the transistor 308C through the connection 334 (in an embodiment that does not include the transistor 308D). The source of each of the transistors 308E and 308F may be electrically coupled to a reference voltage (e.g., the ground 336 as shown in FIG. 3). The drain of the transistor 308E may receive the current from the transistor 308D or 308C through the connection 330 or 334, respectively. The current received at the drain of the transistor 308E may be mirrored to the drain of the transistor 308F such that the current on the connection 328 may be a multiple of the current on the connection 330 and thus a multiple of the current on the connection 332 and a multiple of the current fed back from the slave transistor 306.

Generally, the device 300 includes a current feedback loop (e.g., a current mirror in the example of FIG. 3) in a master-slave voltage regulator device 300. The current feedback loop may help reduce the impact of a dynamic loading on an output voltage (Vout) variation. The current feedback may be designed to help adjust Vop_out by providing current to the amplifier 302 in addition to the master-device bias current as provided by the current source 310. The Ifeedback may be proportional to the loading current (Iload) (e.g., Ifeedback may be set to a specified percentage of the Iload, such as between about one percent and ten percent of the loading current or a higher percentage). As Iload increases, a master-device loop (i.e. the loop that includes the connections 322 and 328) may raise Vop_out, such as in real time, to help supply the increased Ifeedback and Iload accordingly. In this manner, Vout may remain more constant over a wider dynamic range of current loading as compared to a voltage regulator that does not include current feedback, such as the voltage regulator 100.

Also, as compared to a conventional low-dropout voltage-feedback regulator, which is widely used in NAND flash design, the current feedback voltage regulator offers a faster response speed. A conventional voltage feedback regulator usually uses a relatively slow internal Miller compensation scheme to maintain loop stability. As a result, the bandwidth of the low-dropout voltage-feedback regulator is generally limited by a regulator output RC time constant, tRC.tRC= rout_PMOS_common_source*Cdecoupling, where rout_PMOS_common_source is a PMOS output impedance and Cdecoupling is the capacitance of an output decoupling capacitor).

In comparison, a bandwidth of a master slave voltage regulator with current feedback, such as the device 300, is generally higher. This is because the slave transistor 306 (an NMOS follower in the example of FIG. 3) may include a low output-impedance (rout_NMOS_follower) on an output stage of the device 300. Generally speaking, rout_NMOS_follower is lower than rout_PMOS_common_source if the two devices have comparable dimensions. Thus, in terms of speed, the device 300 may demonstrate up to about ten times higher bandwidth than the conventional low-dropout voltage-feedback regulator. According to a simulation of the master-slave voltage regulator with current feedback, a greater bandwidth may be achieved as compared to a bandwidth of a voltage feedback voltage regulator. The voltage feedback voltage regulator generally has a bandwidth of less than five mega Hertz. The current feedback voltage regulator, as discussed herein in one or more embodiments, can have a bandwidth of thirty mega Hertz or greater.

A current feedback voltage regulator can be used in a variety of devices. When used in a NAND type memory device, Vsupp1 is generally about three volts, Vsupp2 is generally between about 1.2 or 1.8 volts, Vref is generally about 1.1 volts or 1.2 volts. The Vbias is generally about 1.0 Volts. These voltages may be configured based on device type, dimension, power requirements, or a combination thereof among others.

Figure 4:
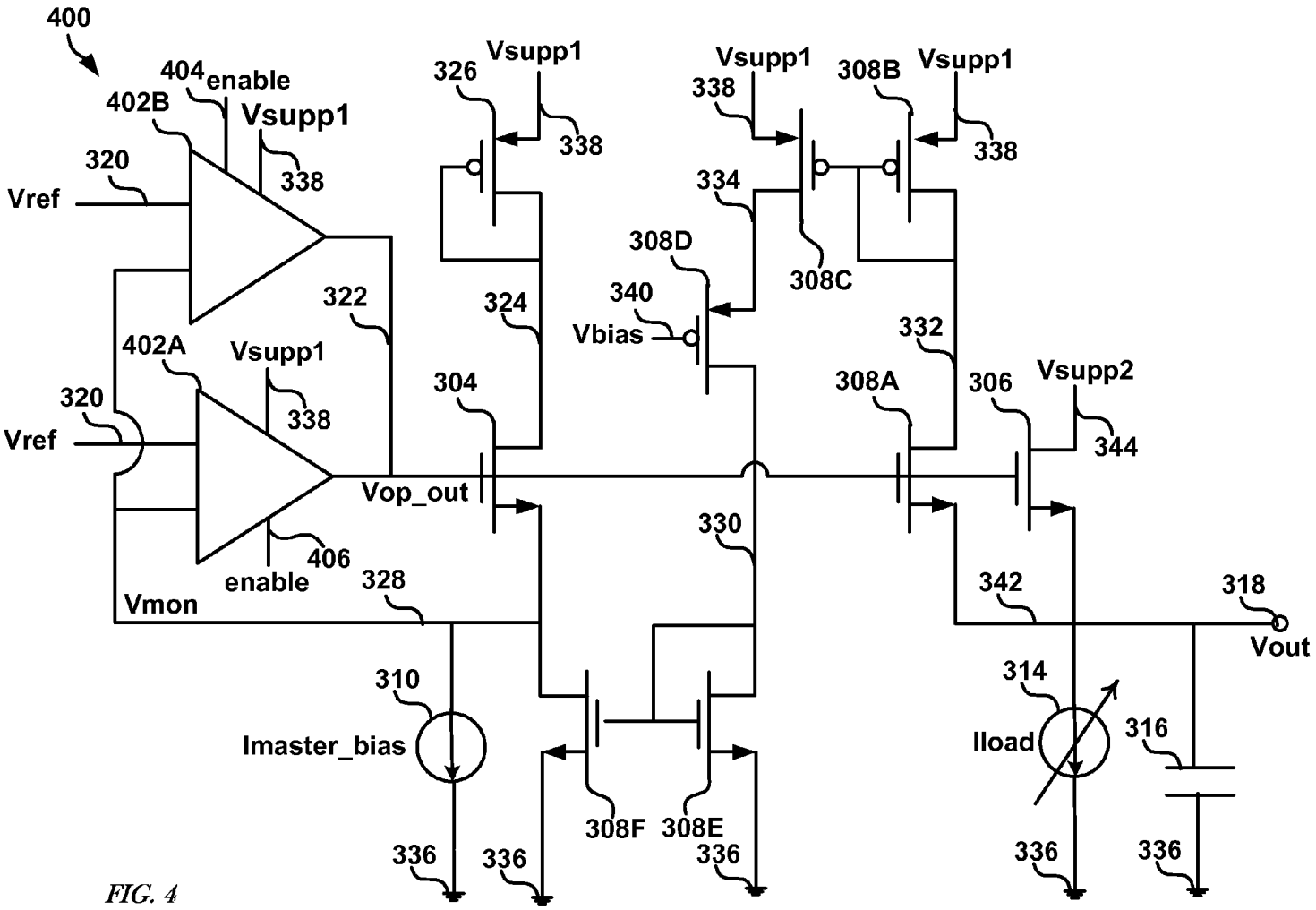
FIG. 4 illustrates, by way of example, a circuit diagram of an embodiment of another voltage regulator device.

FIG. 4 illustrates, by way of example, a circuit diagram of another embodiment of a master-slave voltage regulator device 400. The device 400 may be similar to the device 300 with the device 400 including two amplifiers 402A and 402B. The amplifier 402A may be electrically coupled in the same manner as the amplifier 302. The amplifier 402B may be electrically coupled in parallel with the amplifier 402A and may be electrically coupled in the same manner as the amplifier 302. The amplifier 402B may be operable to provide an output current that is bigger than the output current of the amplifier 402A. In one or more embodiments, the amplifier 402B may be operable to provide a maximum output current that is in the milliamp range (e.g., from about one milliamp to hundreds of milliamps or larger). In one or more embodiments, the amplifier 402A may be operable to provide a maximum output current that is in the microamp range (e.g., from about one microamp to hundreds of microamps).

The amplifier 402B may be enabled through a voltage on the enable line 404, such as before or concurrent with a load on the output 318 becoming active. The amplifier 402B may be disabled using a voltage on the enable line 404, such as after or concurrent with a load on the output 318 becoming inactive. Similarly, the amplifier 402A may be enabled through a voltage on the enable line 406, such as before or concurrent with a load on the output 318 becoming inactive, and enabled using a voltage on the enable line 406, such as after or concurrent with a load on the output 318 becoming active. It is not necessary to switch off (disable) the amplifier 402A in an instance where the current provided by the amplifier 402B is much larger than the current provided by the amplifier 402A. In practice, generally the amplifier 402A remains enabled regardless of the state of the load on the output 318.

Figure 5:
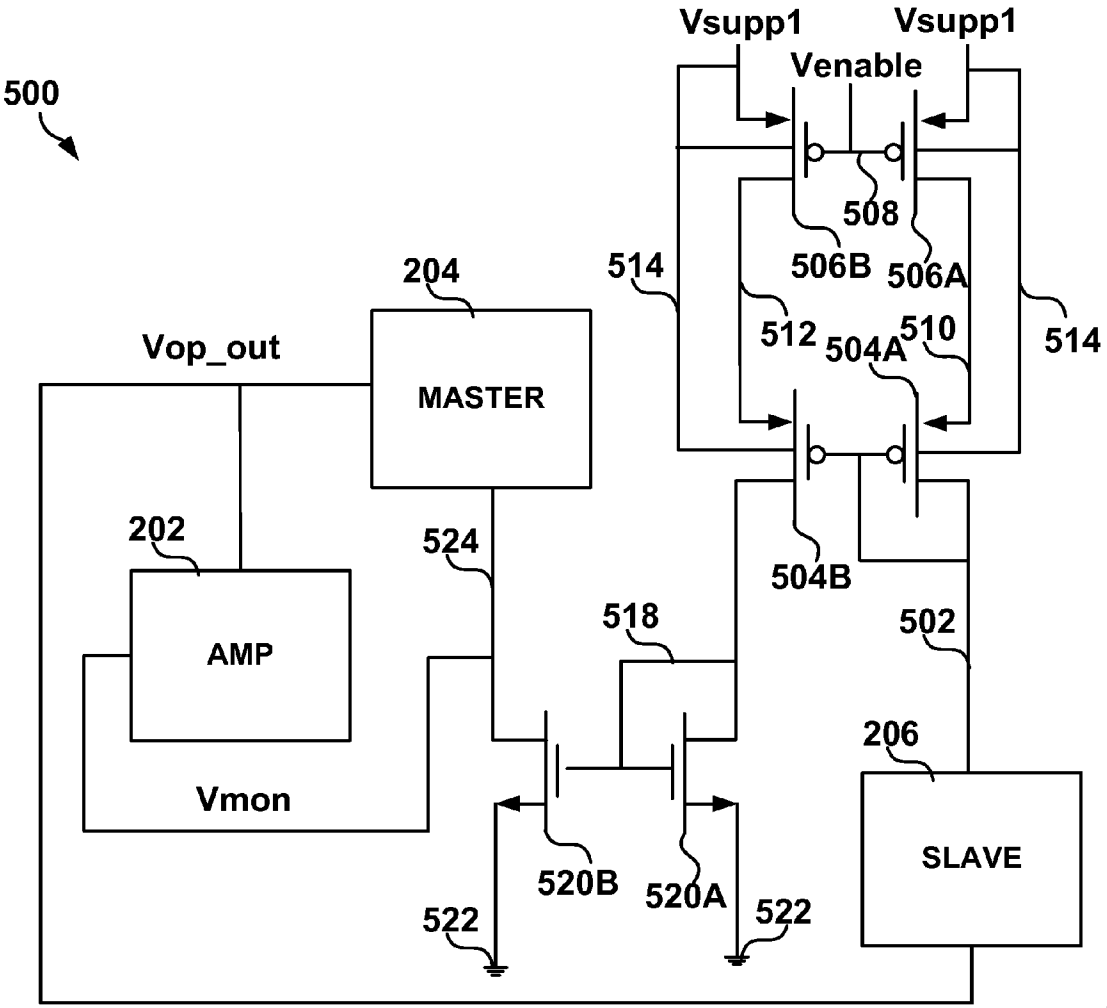
FIG. 5 illustrates, by way of example, a circuit diagram of an embodiment of a current mirror device.

FIG. 5 illustrates, by way of example, a circuit diagram of an embodiment of a master-slave voltage regulator device 500. A circuit diagram of an example embodiment of the current feedback device 208 is provided in FIG. 5. The current feedback device 208 may include the transistors 504A, 504B, 506A, 506B, 520A, 520B, and the connections 502, 512, 514, 518 and/or 524.

The device 500 may include a plurality of transistors 504A, 504B, 506A, 506B, 520A, and 520B arranged to mirror a current received from a slave device 206. The transistor 504A of the current feedback device may receive a current from the slave device 206 at the connection 502. The transistors 504A and 504B may include a gate electrically coupled to the connection 502. The drain of the transistor 504A may be electrically coupled to the connection 502. The body of the transistors 504A, 504B, 506A, and 506B may be electrically coupled to a first supply voltage (Vsupp1) through the connection 514. The source of the transistors 506A and 506B may be electrically coupled to Vsupp1 through the connection 514.

An enable voltage (Venable) may be applied to the gate of the transistors 506A and 506B to activate or deactivate the transistors 506A-B. The enable voltage may activate the transistors 506A and 506B, such as when a load electrically coupled to the device 500 is active. The Venable may deactivate the transistors 506A and 506B, such as before or concurrently with a load electrically coupled the device 500 becomes inactive. By only activating the transistors 506A and 506B when a load electrically coupled to the device 500 becomes active, an amount of power drawn by the device 500 may be reduced. By enabling the transistors 506A and 506B, current may flow from the power supply (Vsupp1) to the transistors 506A and 506B through the connections 510 and 512, thus activating the current mirror provided by the transistors 504A and 504B.

When activated, the transistors 504A and 504B may mirror the current on the connection 502 and provide the mirrored current on the connection 518 coupled to the drain of the transistor 504B. The transistors 520A and 520B may receive the mirrored current at their gates on the connection 518. The transistors 520A and 520B may each include a gate coupled to the connection 518 and a source coupled to a reference voltage (e.g., ground 522). The drain of the transistor 520A may be electrically coupled to the connection 518. The drain of the transistor 520A may receive the mirrored current from the drain of the device 504B. The current mirror comprising the transistors 520A and 520B may mirror the current received on the connection 518 and produce a mirrored version thereof on the connection 524. The mirrored current on the connection 524 may be proportional to the current from the slave device, such as to produce a voltage that changes as the current from the slave device changes.

FIGS. 3, 4, and 5 show examples of current feedback devices that include multiple current mirrors. In one or more embodiments, a single current mirror may be used to feedback current from a slave device. The single current mirror may include a current mirror configured as in the transistors 308E and 308F of FIG. 3 or the transistors 308B and 308C of FIG. 3, for example. The input of the current mirror may be coupled to the source of the slave transistor 306 and the output of the current mirror may be coupled to the source of the master transistor 304, for example. Also, note that the transistors are shown as a single transistor for simplicity, however each of the single transistors may be implemented by multiple transistors may be connected in series or parallel to implement the functionality of the single transistor shown.

Figure 6:
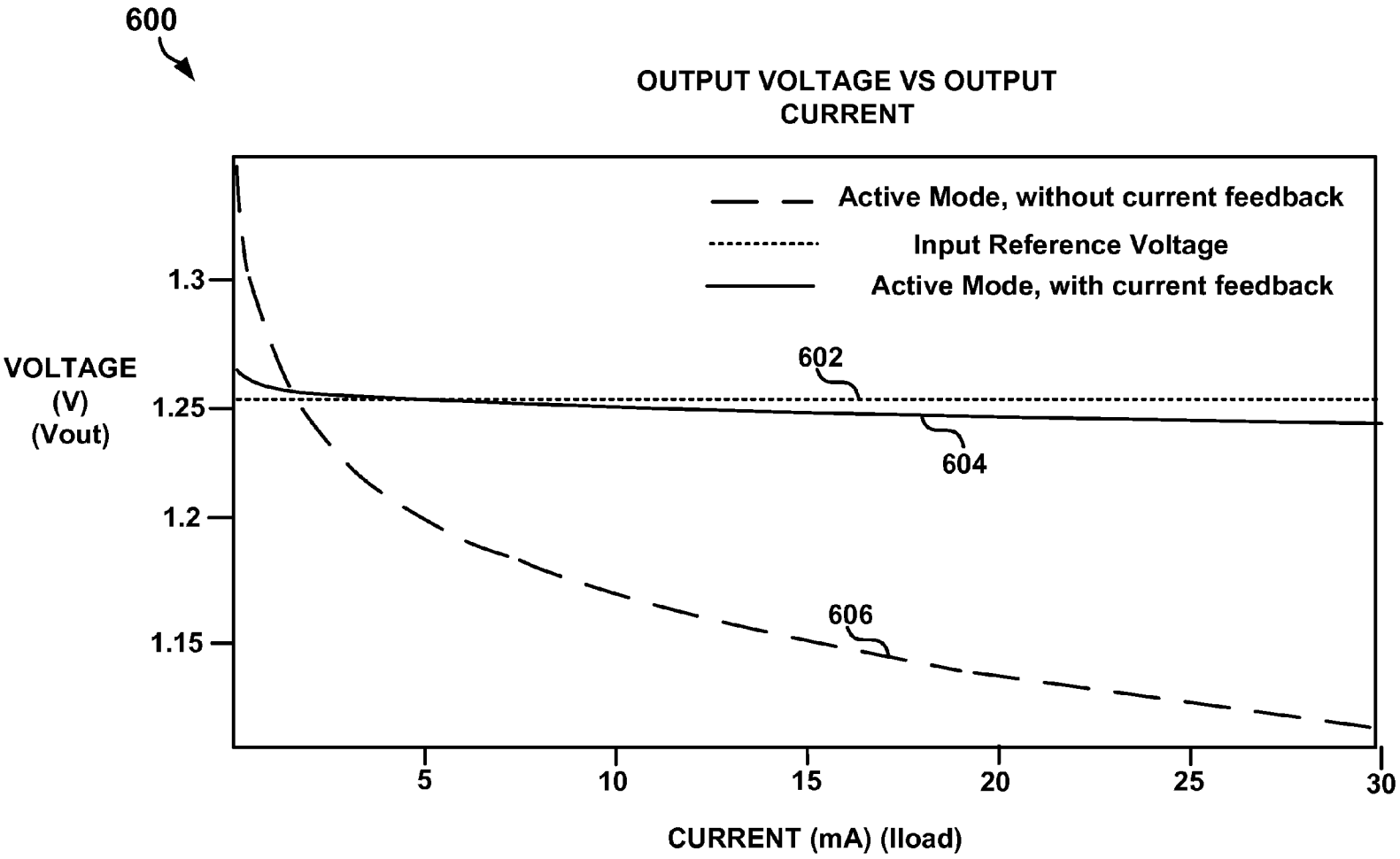
FIG. 6 illustrates, by way of example, a graph of output voltage versus output current for a variety of voltage regulators.

FIG. 6 shows, by way of example, a graph 600 of simulations of output voltage (Vout) vs. output current (Iload) for a variety of voltage regulators. The graph 600 shows output voltage vs. output current for an input reference voltage at 602, a voltage regulator with current feedback operating in active mode at 604, and a voltage regulator without current feedback operating in an active mode (i.e. with an active mode amplifier enabled) at 606. The graph 600 shows that the voltage regulator with current feedback may regulate the output voltage under varying loading currents better than the voltage regulator(s) without current feedback.

Figure 7:
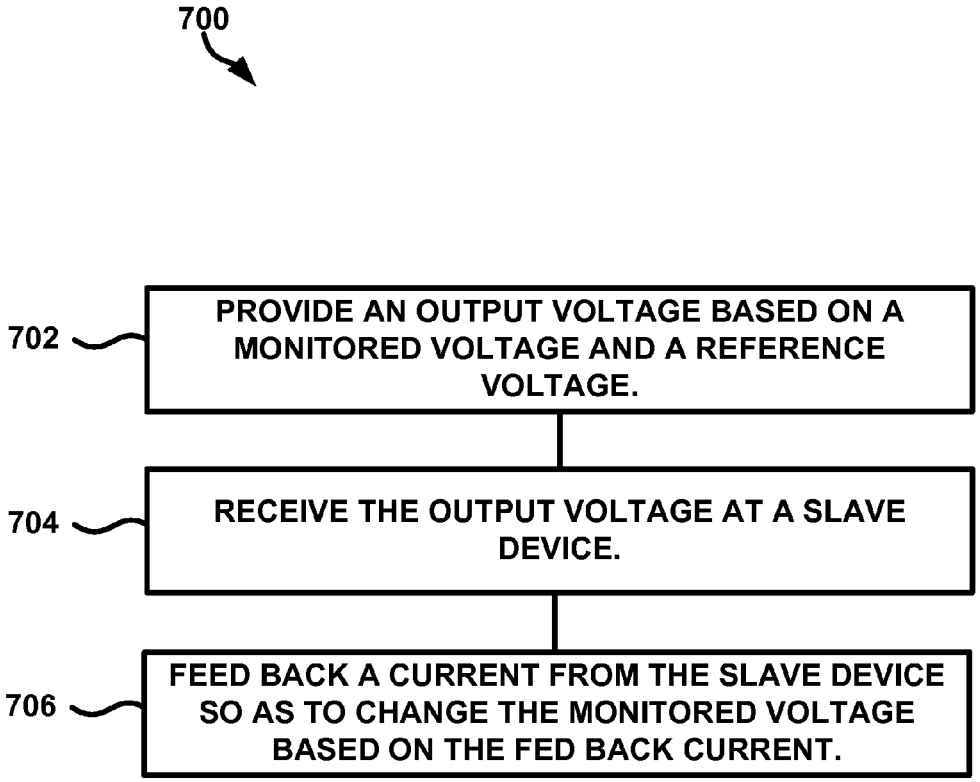
FIG. 7 illustrates, by way of example, a flow chart of an embodiment of a method.

FIG. 7 illustrates, by way of example, a flow diagram of an embodiment of a method 700. The method 700 as illustrated includes: providing an output voltage (e.g., using the amplifier 202) based on a monitored voltage and a reference voltage, at operation 702; receiving the output voltage at a slave device (e.g., the slave device 206), at operation 704; and feeding back a current from the slave device (e.g., using the current feedback device 208) so as to change the monitored voltage using the fed back current, at operation 706. The output voltage may also be received at a master device (e.g., the master device 204).

The operation at 706 may include feeding back the current from the slave device to the amplifier includes mirroring the current from the slave device. The method 700 may include providing a bias current to the master device using a current source. The method 700 may include shunting electricity from the slave device through a decoupling capacitor.

While the above description and drawings illustrate some embodiments using n-type logic or p-type logic, it will be understood that p-type logic or n-type logic could be used. An apparatus or device, as described herein, may refer to any of a system, die, circuit, or the like.

The above description and the drawings illustrate some embodiments to enable those skilled in the art to practice the embodiments of the invention. Other embodiments may incorporate structural, logical, electrical, process, and other changes. Examples merely typify possible variations. Portions and features of some embodiments may be included in, or substituted for, those of other embodiments. Many other embodiments will be apparent to those of skill in the art upon reading and understanding the above description.

What is claimed is:

1. An apparatus comprising:

an amplifier;

a master device electrically coupled to the amplifier device, wherein the master device includes a transistor electrically connected to an output of the amplifier device;

a slave device electrically coupled to the master device; and a current feedback device electrically coupled to the amplifier device and the slave device, the current feedback device to feedback current from the slave device to alter a monitoring voltage input to the amplifier device.

2. The apparatus of claim 1, wherein the amplifier device includes a first operational amplifier and wherein the apparatus further comprises a second operational amplifier, wherein an output of the first operational amplifier and the second operational amplifier are electrically coupled to each other.

3. The apparatus of claim 2, wherein the first operational amplifier is an active mode operational amplifier and the second operational amplifier is a passive mode operational amplifier.

4. The apparatus of claim 1, wherein the current feedback device includes a current mirror electrically coupled to feedback a portion of a load current from the slave device.

5. The apparatus of claim 1, wherein the current feedback device includes a plurality of current mirrors electrically coupled in series to feedback a portion of a load current from the slave device.

6. The apparatus of claim 1, further comprising a current source electrically coupled to the master device and an input of the amplifier.

7. The apparatus of claim 1, further comprising a memory device electrically coupled to the slave device.

8. The apparatus of claim 7, wherein the master device and the slave device are configured to provide a voltage within a range between about 1.1 Volts to about 1.3 Volts under varying load currents.

9. The apparatus of claim 7, wherein the master device and the slave device are configured to provide a voltage within a range between about 1.7 Volts to about 1.9 Volts under varying load currents.

10. An apparatus comprising:

a first operational amplifier including a reference voltage input, a monitor voltage input, and an output;

a second operational amplifier including a reference voltage input electrically coupled to the reference voltage input of the first operational amplifier, a monitor voltage input electrically coupled to the monitor voltage input of the first operational amplifier, and an output electrically coupled to the output of the first operational amplifier;

a master transistor including a gate electrically coupled to the output of the first and second operational amplifiers and a source electrically coupled to the monitor voltage input of the first and second operational amplifiers;

a slave transistor including a gate electrically coupled to the gate of the master transistor, the slave transistor including a source output, and a drain; and a current mirror including an input electrically coupled to the drain of the slave transistor and an output electrically coupled to the monitor voltage input of the first and second operational amplifiers.

11. The apparatus of claim 10, wherein the current mirror includes a transistor including a gate electrically coupled to the gate of the second transistor and a source electrically coupled to the source of the second transistor.

12. The apparatus of claim 10, wherein the current mirror further includes:

a first P-type Metal Oxide Semiconductor (PMOS) transistor including a gate and a drain electrically coupled to the drain of the slave transistor; and a second PMOS transistor including a gate electrically coupled to the drain of the slave transistor.

13. The apparatus of claim 12, wherein the current mirror includes:

a first N-type MOS (NMOS) transistor including a gate and a drain electrically coupled to the drain of the second PMOS transistor; and a second NMOS transistor including a gate electrically coupled to the gate of the first NMOS transistor and a drain electrically coupled to the monitor voltage input of the first operational amplifier.

14. The apparatus of claim 12, wherein the current mirror further includes a first enable transistor electrically coupled to the first PMOS transistor and a second enable transistor electrically coupled the second PMOS transistor.

15. The apparatus of claim 10, further comprising a current source electrically coupled to the source of the master transistor.

16. The apparatus of claim 10, wherein the first operational amplifier is configured to supply a current of about one milliamp to about ten milliamps in response to the first operational amplifier being activated and wherein the second operational amplifier is configured to supply a current of about one microamp to about ten microamps.

17. A method comprising:

providing, using an amplifier, an output voltage based on a monitored voltage and a reference voltage;

receiving, at a transistor of a master device and at a slave device, the output voltage, the transistor electrically connected to an output of the amplifier; and feeding back a current from the slave device so as to change the monitored voltage using the fed back current.

18. The method of claim 17, wherein feeding back the current from the slave device includes mirroring the current from the slave device.

19. The method of claim 17, further comprising providing a bias current to the master device using a current source.

20. The method of claim 17, further comprising shunting electricity from the slave device through a decoupling capacitor.

* * * * *